US012140326B2

(12) United States Patent
Takeichi et al.

(10) Patent No.: US 12,140,326 B2
(45) Date of Patent: Nov. 12, 2024

(54) HEAT EXCHANGER AND AIR CONDITIONER INCLUDING THE SAME

(71) Applicant: SAMSUNG ELECTRONICS CO., LTD., Suwon-si (KR)

(72) Inventors: Hisashi Takeichi, Yokohama (JP); Hyunyoung Kim, Yokohama (JP); Ryo Inoha, Yokohama (JP); Kazushige Tajima, Yokohama (JP); Masatoshi Takahashi, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 379 days.

(21) Appl. No.: 17/559,567

(22) Filed: Dec. 22, 2021

(65) Prior Publication Data

US 2022/0196255 A1 Jun. 23, 2022

Related U.S. Application Data

(63) Continuation of application No. PCT/KR2021/017170, filed on Nov. 22, 2021.

(30) Foreign Application Priority Data

Dec. 23, 2020 (JP) ..... 2020-213922

(51) Int. Cl.
*F24F 1/0059* (2019.01)

(52) U.S. Cl.
CPC ..... *F24F 1/0059* (2013.01)

(58) Field of Classification Search
CPC ..... F24F 1/0059
See application file for complete search history.

(56) References Cited

U.S. PATENT DOCUMENTS 3,151,676 A 10/1964 Otto et al.
2016/0025420 A1 1/2016 O'Coin et al.
2018/0156512 A1* 6/2018 Mislak ..... F28F 9/0265

FOREIGN PATENT DOCUMENTS

EP 3 244 139 B1 4/2020
JP 2015-55412 3/2015
(Continued)

OTHER PUBLICATIONS

Arino, Condenser, Feb. 21, 2019, JP2019027685A, Whole Document (Year: 2019).*
(Continued)

*Primary Examiner* — Larry L Furdge
(74) *Attorney, Agent, or Firm* — STAAS & HALSEY LLP

(57) ABSTRACT

A heat exchanger includes a main pipe through which refrigerant flows, a plurality of tubes connected to the main pipe to allow refrigerant passing through the plurality of tubes to exchange heat with air, and a refrigerant distributor disposed between the main pipe and the plurality of tubes, to distribute refrigerant passing through the main pipe to the plurality of tubes. The refrigerant distributor includes an upstream structure connected to the main pipe and including a plurality of first distribution flow paths to which the refrigerant passing through the main pipe are distributed, and a downstream structure including a plurality of second distribution flow paths communicating with the plurality of first distribution flow paths, and a plurality of refrigerant outlets communicating with the plurality of second distribution flow paths so as to allow the refrigerant to be discharged to the plurality of tubes.

18 Claims, 13 Drawing Sheets

(56) References Cited

FOREIGN PATENT DOCUMENTS

| | | | | |
|---|---|---|---|---|
| JP | 6446990 | B2 | | 1/2019 |
| JP | 2019027685 | A | * | 2/2019 |
| JP | 6766980 | B1 | | 10/2020 |
| KR | 10-2013-0123995 | | | 11/2013 |

OTHER PUBLICATIONS

International Search Report dated Mar. 18, 2022 in International Patent Application No. PCT/KR2021/017170 (3 pages; 4 pages English translation).

* cited by examiner

HEAT EXCHANGER AND AIR CONDITIONER INCLUDING THE SAME

CROSS REFERENCE TO RELATED APPLICATIONS

This application is a continuation application under 35 U.S.C. § 111 (a) of International Application No. PCT/KR2021/017170, filed on Nov. 22, 2021, which claims priority to Japanese Patent Application No. 2020-213922 filed on Dec. 23, 2020. The disclosures of International Application No. PCT/KR2021/017170 and Japanese Patent Application No. 2020-213922 are incorporated by reference herein in their entirety.

BACKGROUND

1. Field

The disclosure relates to a heat exchanger including a refrigerant distributor including an improved structure, and an air conditioner including the heat exchanger.

2. Description of the Related Art

As described by Japanese Patent No. 6446990, a heat exchanger is provided with a plurality of small diameter tubes, such as a multi-bored flat tube, to improve performance of evaporator.

In the case of constructing a large vertical outdoor unit using such a small diameter tube, a difficulty, in that a pressure loss is maximized as a length of the small diameter tube is increased, may occur and thus multi-pass, in which the number of times of uses of the small diameter tube is increased, is required to ease the difficulty.

In this multi-pass type vertical outdoor unit, because a number of small diameter tubes are arranged in upper and lower stages, a wind speed is high in an upper part close to a fan, and thus heat exchange in the upper part may be performed efficiently. However, a wind speed is low in a lower part far away from the fan and thus, when a large amount of refrigerant is supplied, it is difficult to perform heat exchange with all of the refrigerant. Accordingly, for effective heat exchange, it is required to supply a large amount of refrigerant to the small diameter tube in the upper part and to supply a small amount of refrigerant to the small diameter tube in the lower part.

In consideration of this point, in order to perform efficient heat exchange in the multi-pass configuration, a distributor configured to distribute an amount of refrigerant supplied to each small diameter tube is required, particularly, the distributor is configured to distribute an appropriate amount of refrigerant according to the wind speed.

However, the distributor is a configuration that distributes the refrigerant in stages. For example, in order to distribute an appropriate amount of the refrigerant supplied to the small diameter tube of about 100-pass, it is required to enlarge the distributor or provide a plurality of distributors. However, there is a limit to the installation space of the large distributor or the plurality of distributors, and thus it is difficult to implement the large distributor or the plurality of distributors.

SUMMARY

Additional aspects of the disclosure will be set forth in part in the description which follows and, in part, will be obvious from the description, or may be learned by practice of the example embodiments disclosed herein.

In accordance with an aspect of the disclosure, a heat exchanger includes a main pipe through which refrigerant is to flow, a plurality of (e.g., small diameter) tubes connected to the main pipe to allow refrigerant passing through the plurality of tubes to exchange heat with air, and a refrigerant distributor disposed between the main pipe and the plurality of tubes, and configured to distribute refrigerant passing through the main pipe to the plurality of tubes. The refrigerant distributor includes an upstream structure connected to the main pipe and including a plurality of first distribution flow paths to which the refrigerant passing through the main pipe is distributed, and a downstream structure including a plurality of second distribution flow paths communicating with the plurality of first distribution flow paths, and a plurality of refrigerant outlets communicating with the plurality of second distribution flow paths so as to allow the refrigerant to be discharged to the plurality of tubes.

The downstream structure may include a partition member connected to the plurality of tubes, an opening forming member in which the plurality of refrigerant outlets is formed, and a flow path forming member to avow the opening forming member to be fitted into the flow path forming member so as to form the plurality of second distribution flow paths between the opening forming member and the flow path forming member.

The partition member may include a plurality of partition spaces corresponding to the plurality of tubes, and a plurality of partition plates to define the plurality of partition spaces.

The plurality of refrigerant outlets may be configured to allow the plurality of second distribution flow paths to communicate with the plurality of partition spaces, and the opening forming member may include a plurality of slits fitted to the flow path forming member to form the plurality of second distribution flow paths.

The plurality of refrigerant outlets may have different sizes to adjust an amount of refrigerant discharged into the plurality of tubes.

A number of refrigerant outlets which communicate with each of the plurality of tubes may be varied to adjust an amount of refrigerant discharged into the plurality of tubes.

The plurality of tubes may be formed to include a plurality of stages in a vertical direction, and the plurality of partition spaces corresponding to the plurality of tubes and the plurality of refrigerant outlets communicating with the plurality of partition spaces may be disposed along the vertical direction.

The plurality of refrigerant outlets may be spirally disposed along a flow direction of the plurality of second distribution flow paths.

The upstream structure may include a connecting member to which the main pipe is connected and the plurality of first distribution flow paths are formed, and a flow path changing body connected to the connecting member so as to change a direction of the refrigerant flowing in the plurality of first distribution flow paths to allow the refrigerant to flow to the plurality of second distribution flow paths.

The connecting member may include a collision surface with which the refrigerant passing through the main pipe collides, and a protrusion protruding in a direction, which is opposite to a direction in which the refrigerant flows, and disposed in a central portion of the collision surface. The plurality of first distribution flow paths may be formed around the protrusion to pass through the connecting member, and an inlet of the plurality of first distribution flow paths may be formed on the collision surface.

The flow path changing body may include a longitudinal flow path forming member, in which a longitudinal flow path communicating with the plurality of first distribution flow paths is formed to allow the refrigerant to flow in a same direction as a direction in which the refrigerant flows through the plurality of first distribution flow paths, a transverse flow path forming member in which a transverse flow path intersecting with the longitudinal flow path is formed, and a communication hole member in which a communication hole is formed, to allow the longitudinal flow path to communicate with the transverse flow path.

In accordance with an aspect of the disclosure, an air conditioner may include a blower, and a heat exchanger to perform heat exchange between refrigerant and air passed from the blower. The heat exchanger may include a main pipe through which refrigerant is to flow, a plurality of tubes connected to the main pipe to allow refrigerant passing through the plurality of tubes to exchange heat with the air, and a refrigerant distributor disposed between the main pipe and the plurality of tubes, and configured to distribute refrigerant passing through the main pipe to the plurality of tubes. The refrigerant distributor may include an upstream structure connected to the main pipe and including a plurality of first distribution flow paths to which the refrigerant passing through the main pipe is distributed, and a downstream structure including a plurality of second distribution flow paths communicating with the plurality of first distribution flow paths, and a plurality of refrigerant outlets communicating with the plurality of second distribution flow paths so as to allow the refrigerant to be discharged to the plurality of tubes.

In accordance with an aspect of the disclosure, a heat exchanger may include a main pipe through which refrigerant is to flow, a plurality of tubes connected to the main pipe to allow refrigerant passing through the plurality of tubes to exchange heat with air, and a refrigerant distributor disposed between the main pipe and the plurality of tubes, and configured to distribute refrigerant passing through the main pipe to the plurality of tubes/The refrigerant distributor may include an upstream structure connected to the main pipe and including a connecting member in which a plurality of first distribution flow paths, to which the refrigerant passing through the main pipe is distributed, are formed, and a downstream structure including a flow path forming member in which a plurality of second distribution flow paths communicating with the plurality of first distribution flow paths are formed, and an opening forming member in which a plurality of refrigerant outlets, which communicate with the plurality of second distribution flow paths so as to allow the refrigerant to be discharged to the plurality of tubes, are formed.

In accordance with an aspect of the disclosure; a refrigerant distributor may be disposed between a main pipe and a plurality of tubes of a heat exchanger and be configured to distribute refrigerant passing through the main pipe to the plurality of tubes. The refrigerant distributor may include an upstream structure connected to the main pipe and including a connecting member in which a plurality of first distribution flow paths, to which the refrigerant passing through the main pipe is distributed, are formed, and a downstream structure including a plurality of second distribution flow paths communicating with the plurality of first distribution flow paths so as to distribute refrigerant to the plurality of tubes. The downstream structure may include a flow path forming member in which the plurality of second distribution flow paths communicating with the plurality of first distribution flow paths are formed, a partition member in which a plurality of partition spaces connected to the plurality of tubes are formed, and an opening forming member in which a plurality of refrigerant outlets, which allows the plurality of second distribution flow paths to communicate with the plurality of partition spaces, are formed.

BRIEF DESCRIPTION OF THE DRAWINGS

These and/or other aspects, features, and advantages of the example embodiments of the disclosure will become apparent and more readily appreciated from the following description of embodiments, taken in conjunction with the accompanying drawings of which.

DETAILED DESCRIPTION

Figure 1:
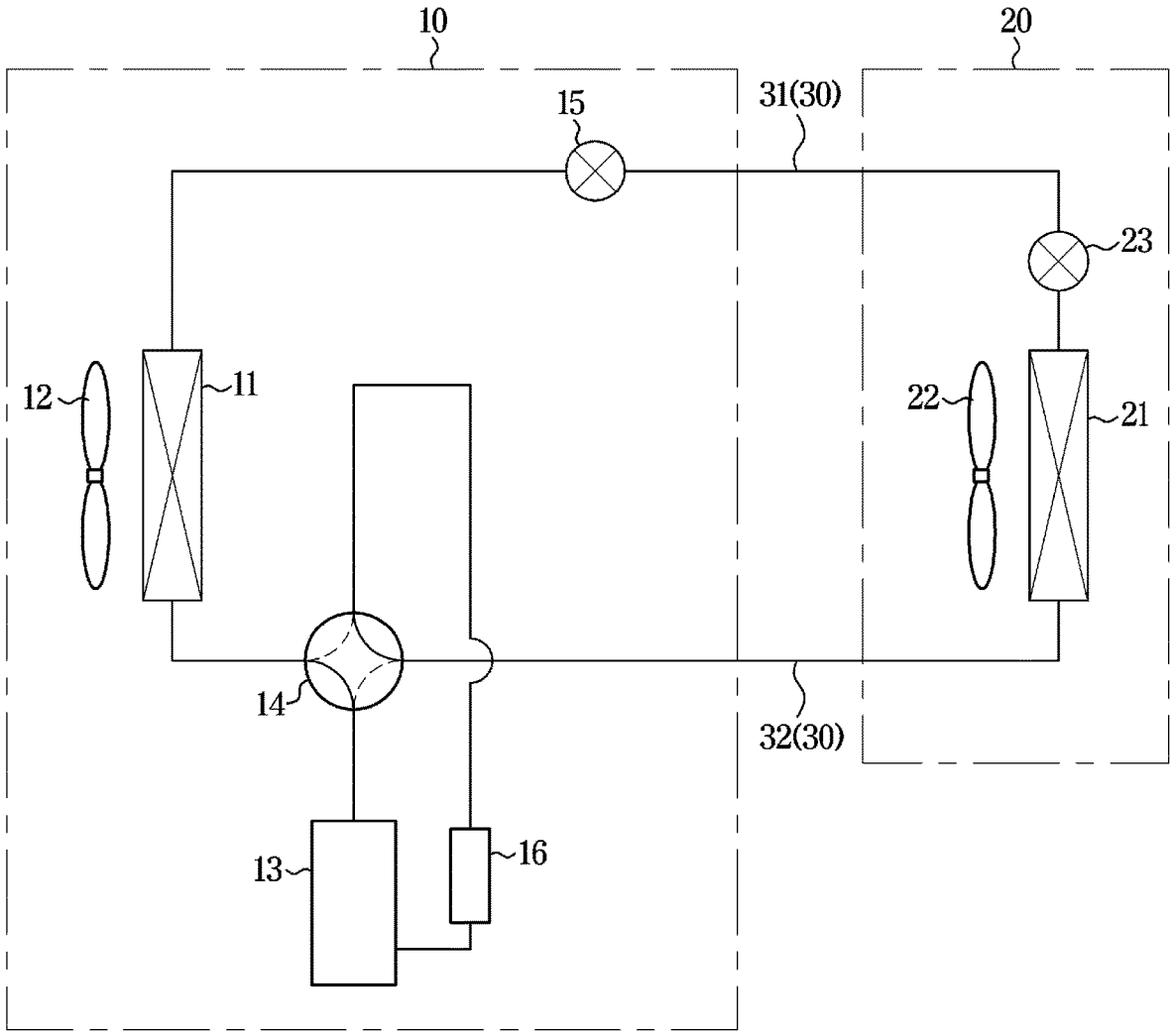
FIG. 1 is a schematic configuration diagram of an air conditioner according to an embodiment of the disclosure.

Embodiments described in the disclosure and configurations illustrated in the drawings are merely examples of the embodiments of the disclosure, and may be modified in various different ways to replace the embodiments and drawings of the disclosure.

In addition, the same reference numerals or signs illustrated in the drawings of the disclosure indicate elements or components performing substantially the same function. The shapes and sizes of elements in the drawings may be exaggerated for clear description.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that when an element is referred to as being "connected" to another element, the expression encompasses an example of a direct connection or direct coupling, as well as a connection or coupling with another element interposed therebetween.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element.

The scope of the expression or phrase of "and/or" includes a plurality of combinations of relevant items or any one item among a plurality of relevant items. For example, the scope of the expression or phrase "A and/or B" includes the item "A", the item "B", and the combination of items "A and B".

In addition, the scope of the expression or phrase "at least one of A and B" is intended to include all of the following: (1) at least one of A, (2) at least one of B, and (3) at least one A and at least one of B. Likewise, the scope of the expression or phrase "at least one of A, B, and C" is intended to include all of the following: (1) at least one of A, (2) at least one of B, (3) at least one of C, (4) at least one of A and at least one of B, (5) at least one of A and at least one of C, (6) at least one of B and at least one of C, and (7) at least one of A, at least one of B, and at least one of C.

In the following detailed description, the terms of "front end", "rear end", "upper portion", "lower portion", "upper end", "lower end" and the like may be defined by the drawings, but the shape and the location of the component is not limited by the term.

The disclosure will be described more fully hereinafter with reference to the accompanying drawings.

One or more aspects of the disclosure relate to a heat exchanger capable of distributing an appropriate amount of refrigerant supplied to a plurality of small diameter tubes, and an air conditioner including the heat exchanger.

As illustrated in FIG. 1, an air conditioner may include an outdoor unit 10 arranged in an outdoor space, an indoor unit 20 installed in an indoor space, and refrigerant pipes 30 provided to connect the outdoor unit 10 and the indoor unit 20 to allow refrigerant to circulate between the outdoor unit 10 and the indoor unit 20.

Although it is illustrated that one indoor unit 20 is connected to one outdoor unit 10 in the drawing, the disclosure is not limited thereto. Alternatively, a plurality of indoor units 20 may be connected to one outdoor unit 10.

The outdoor unit 10 may include an outdoor heat exchanger 11 configured to perform heat exchange between outdoor air and refrigerant, an outdoor blower 12 configured to allow outdoor air to pass through the outdoor heat exchanger 11, a compressor 13 configured to compress the refrigerant, a four-way valve 14 configured to guide the refrigerant discharged from the compressor 13 to one of the outdoor unit 10 and the indoor unit 20, an outdoor expansion valve 15 configured to decompress and expand the refrigerant, and an accumulator 16 configured to separate liquid refrigerant from the refrigerant introduced into the compressor 13 and configured to allow the liquid refrigerant to be vaporized and then to be introduced into the compressor 13.

The indoor unit 20 may include an indoor heat exchanger 21 configured to perform heat exchange between indoor air and refrigerant, an indoor blower 22 configured to allow indoor air to pass through the indoor heat exchanger 21, and an indoor expansion valve 23 configured to decompress and expand the refrigerant.

The refrigerant pipe 30 may include a liquid refrigerant pipe 31 through which liquid refrigerant passes, and a gaseous refrigerant pipe 32 through which gaseous refrigerant passes. The liquid refrigerant pipe 31 may allow the refrigerant to flow between the indoor expansion valve 23 and the outdoor expansion valve 15. The gaseous refrigerant pipe 32 may guide the refrigerant to move between the four-way valve 14 of the outdoor unit 10 and a gas side of the indoor heat exchanger 21 of the indoor unit 20.

It may be appropriate to use any one of HO single refrigerant, HO-mixed refrigerant, R32, R410A, R4070, and carbon dioxide as the refrigerant used in the air conditioner.

Figure 2:
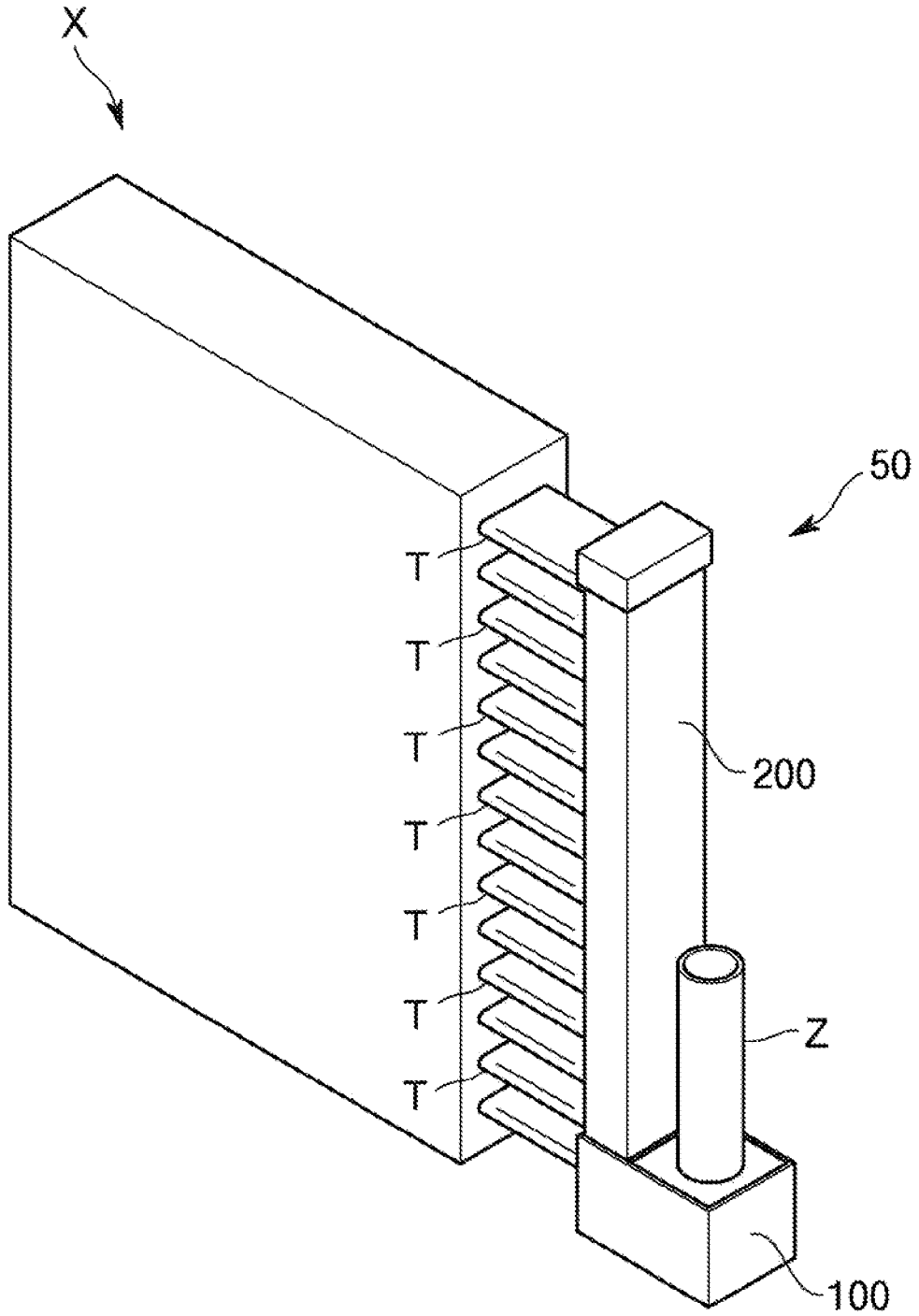
FIG. 2 is a perspective view illustrating a heat exchanger according to an embodiment of the disclosure.

As illustrated in FIG. 2, the refrigerant distributor 50 according to an embodiment forms a heat exchanger X of the air conditioner, and the heat exchanger X may correspond to the outdoor heat exchanger 11 (refer to FIG. 1). The outdoor heat exchanger 11 may be provided as a large vertical type outdoor heat exchanger. However, the disclosure is not limited thereto, and the heat exchanger X may be a heat exchanger 11 provided as a large horizontal outdoor heat exchanger. In addition, the heat exchanger X may correspond to the indoor heat exchanger 21.

Figure 3:
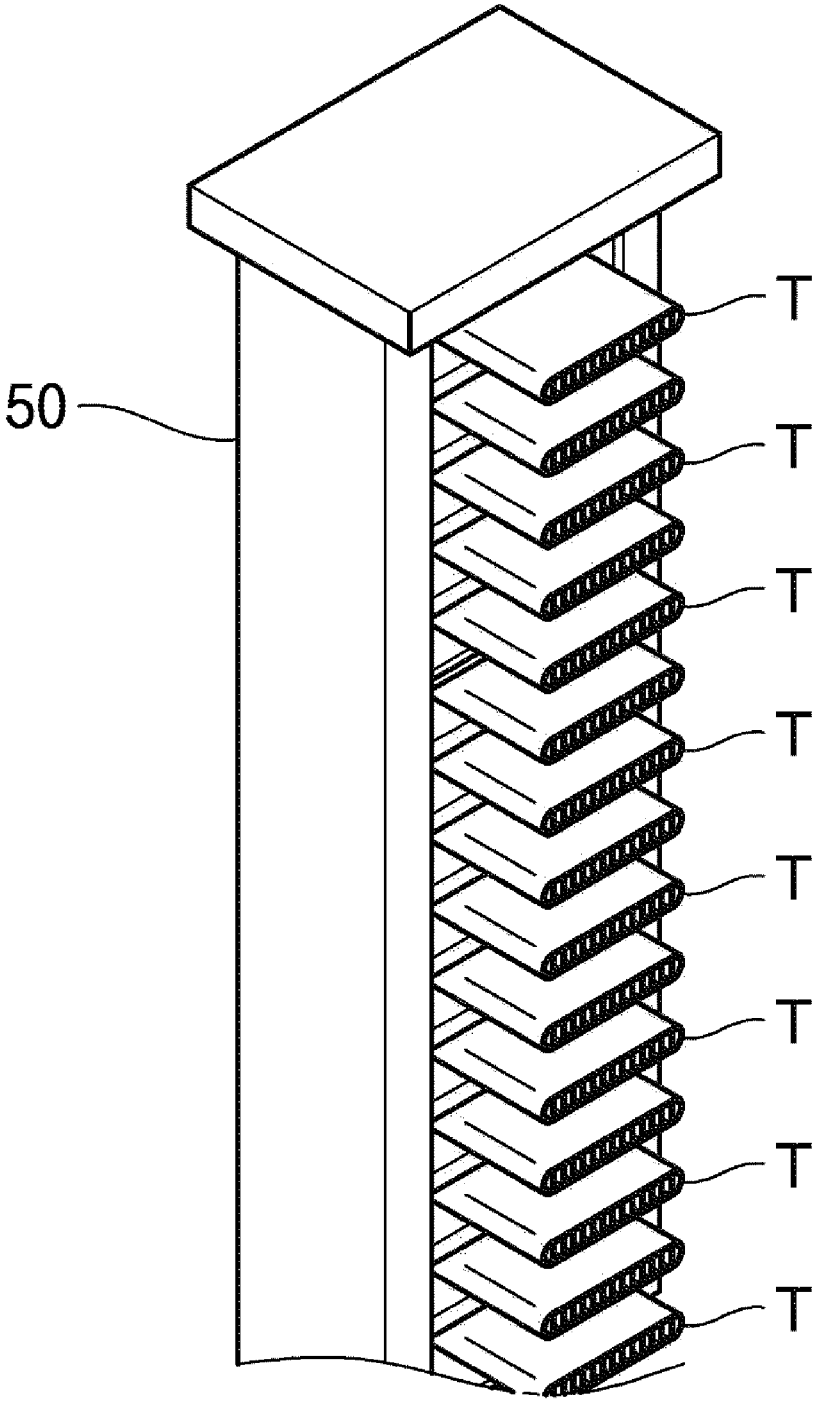
FIG. 3 is a view illustrating a state in which a plurality of small diameter tubes is connected to a refrigerant distributor according to an embodiment of the disclosure.

As illustrated in FIG. 2, the heat exchanger X may include a plurality of small diameter tubes (heat transfer tubes) T and the refrigerant distributor 50 may be configured to distribute refrigerant, which is introduced into the heat exchanger X, to the plurality of small diameter tubes T. As illustrated in FIG. 3, the heat exchanger X may be provided in such a way that multi-bored flat tubes, which are a plurality of small diameter tubes T, are arranged in a plurality of stages in the vertical direction.

As illustrated in FIG. 2, the refrigerant distributor 50 distributes the refrigerant flowing through a main pipe Z provided on an upstream side of the heat exchanger X to the plurality of small diameter tubes T described above, and the refrigerant distributor 50 may include an upstream structure 100 to which the main pipe Z is connected and a downstream structure 200 to which the plurality of small diameter tubes T is connected.

First, the upstream structure 100 will be described.

Figure 4:
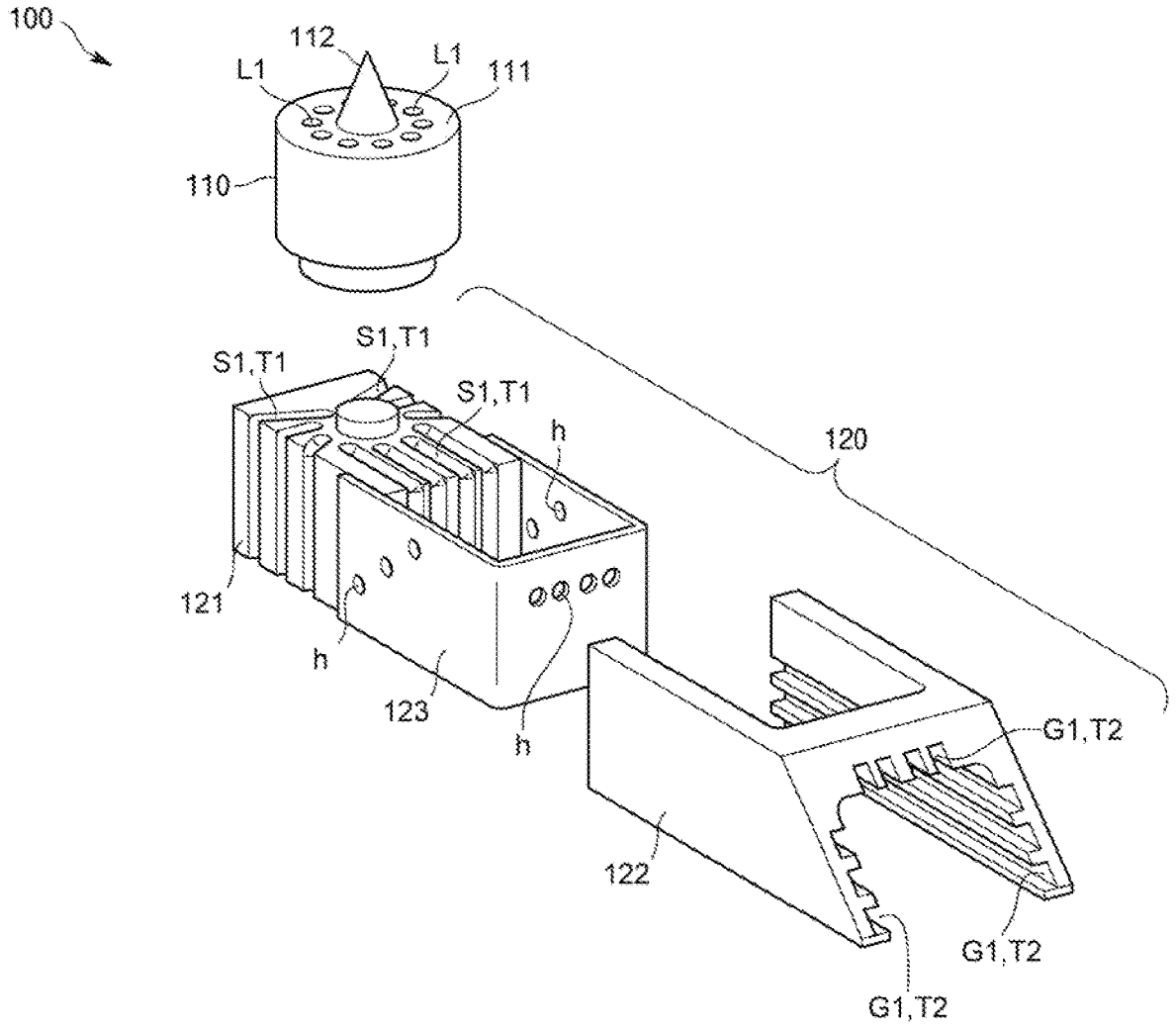
FIG. 4 is an exploded view illustrating an upstream structure of the refrigerant distributor according to an embodiment of the disclosure.

As illustrated in FIG. 4, the upstream structure 100 may include a plurality of first distribution flow paths L1 to distribute the refrigerant passing through the main pipe Z to the first distribution flow paths L1, and the upstream structure 100 may have a function of changing a direction in which the refrigerant flows as well as a function of distributing the refrigerant.

For example, as illustrated in FIG. 4, the upstream structure 100 may include a connecting member 110 in which the plurality of first distribution flow paths L1 is formed as an internal flow path, and a flow path changing body 120 provided to change a direction of the refrigerant flowing in the first distribution flow path L1. The connecting member 110 may perform the above-described distribution function, and the flow path changing body 120 may perform the above-described function of changing the flow direction of the refrigerant.

The main pipe Z may be connected to the connecting member 110, and an inlet of the first distribution flow path L1 may be opened on a collision surface 111 with which the refrigerant flowing through the main pipe Z is in contact.

The first distribution flow path L1 may be formed to pass through the connecting member 110. Although ten first distribution flow paths L1 are formed in the example of FIG. 4, the number of the first distribution flow paths may vary.

The main pipe Z may be provided to allow the refrigerant to flow from an upper side to a lower side, and an upper surface of the connecting member 110 may be the collision surface 111. A protrusion 112 may be provided on the collision surface 111 in a direction opposite to the refrigerant flowing through the main pipe Z. The protrusion 112 may have a conical shape formed in a central portion of the collision surface 111, and a plurality of inlets (for example, ten inlets according to an embodiment) may be arranged at equal intervals along a circumferential direction around the protrusion 112.

As illustrated in FIG. 4, the flow path changing body 120 may be provided to change the direction of the refrigerant flowing through the main pipe Z, that is the direction of the refrigerant flowing through the first distribution flow path L1, to a direction of refrigerant flowing through a second flow path L2 described later, and for example, the flow path changing body 120 may be provided to reverse a direction of refrigerant that is from the upper side to the lower side, to a direction of refrigerant that is from the lower side to the upper side.

For example, the flow path changing body 120 may include a longitudinal flow path forming member 121 forming a longitudinal flow path T1 along the first distribution flow path L1, a transverse flow path forming member 122 forming a transverse flow path T2 crossing the longitudinal flow path T1, and a communication hole member 123 interposed between the longitudinal flow path forming member 121 and the transverse flow path forming member 122 and in which a communication hole h, which allows the longitudinal flow path T1 to communicate with the transverse flow path T2, is formed.

The longitudinal flow path forming member 121 may form a plurality (for example, ten, according to an embodiment) of longitudinal flow paths T1 provided to correspond to the plurality of first distribution flow paths L1, respectively. For example, the longitudinal flow path forming member 121 may be formed in a square column shape, and a slit S1 may be formed to vertically penetrate a plurality of portions on some (three outer surfaces according to an embodiment) of outer surfaces of the longitudinal flow path forming member 121. Alternatively, the slit S1 does not necessarily have to be in the vertical direction and may be inclined with respect to the vertical direction. By covering the outer surface of the longitudinal flow path forming member 121 with the communication hole member 123 to be described later, the slit S1 may be closed, thereby forming the longitudinal flow path T1.

The transverse flow path forming member 122 may form a plurality (for example, ten, according to an embodiment) of transverse flow paths T2 provided to correspond to the plurality of longitudinal flow paths T1, respectively. For example, the transverse flow path forming member 122 may include an inner surface (three inner surfaces according to an embodiment) arranged opposite to the outer surface of the longitudinal flow path forming member 121, and a groove G1 may be formed on the inner surface in a horizontal direction. Alternatively, the groove G1 does not necessarily have to be in the horizontal direction, and may be inclined upward or downward with respect to the horizontal direction. By covering the inner surface of the transverse flow path forming member 122 with the communication hole member 123 to be described later, the groove G1 may be closed, thereby forming the transverse flow path T2.

The communication hole member 123 may be interposed between the outer surface of the longitudinal flow path forming member 121 and the inner surface of the transverse flow path forming member 122, and the communication hole h may be formed at the intersection portion of the longitudinal flow path T1 and the transverse flow path T2 to allow the longitudinal flow path T1 and the transverse flow path T2 to communicate with each other. For example, the longitudinal flow path T1 and the transverse flow path T2 may be perpendicular to one another. For example, the transverse flow path T2 may be transverse to the longitudinal flow path T1.

For example, the communication hole member 123 may be formed in such a way that a flat member is bent into a '⊏' shape, and one or a plurality of communication holes h may be formed on each bent surface. As shown in FIG. 4, a shape of the communication hole h may be circular. However, the disclosure is not so limited and a shape of the communication hole h may vary. In addition, FIG. 4 illustrates a plurality of communication holes h (for example, three communication holes h) arranged in a diagonal pattern on each of two sides of the communication hole member 123, a plurality of communication holes h (for example, four communication holes h) arranged horizontally on a third side of the communication hole member 123.

By fitting the communication hole member 123 to the outside of the longitudinal flow path forming member 121 according to the above-described configuration, the plurality of longitudinal flow paths T1 may be formed independently of each other, and at the same time, by fitting the communication hole member 123 to the inside of the transverse flow path forming member 122, the plurality of transverse flow paths T2 may be formed independently of each other. Each of the plurality of longitudinal flow paths T1 may communicate with a corresponding one of the plurality of transverse flow paths T2 through the communication hole h. That is, the plurality of longitudinal flow paths T1 and the plurality of transverse flow paths T2 may be in communication with each other in one-to-one correspondence. However, the disclosure is not limited thereto, and a plurality (e.g., two or more) of transverse flow paths T2 may communicate with one longitudinal flow path T1, or one transverse flow path T2 may communicate with a plurality (e.g., two or more) of longitudinal flow paths T1.

Next, the downstream structure 200 will be described.

Figure 5:
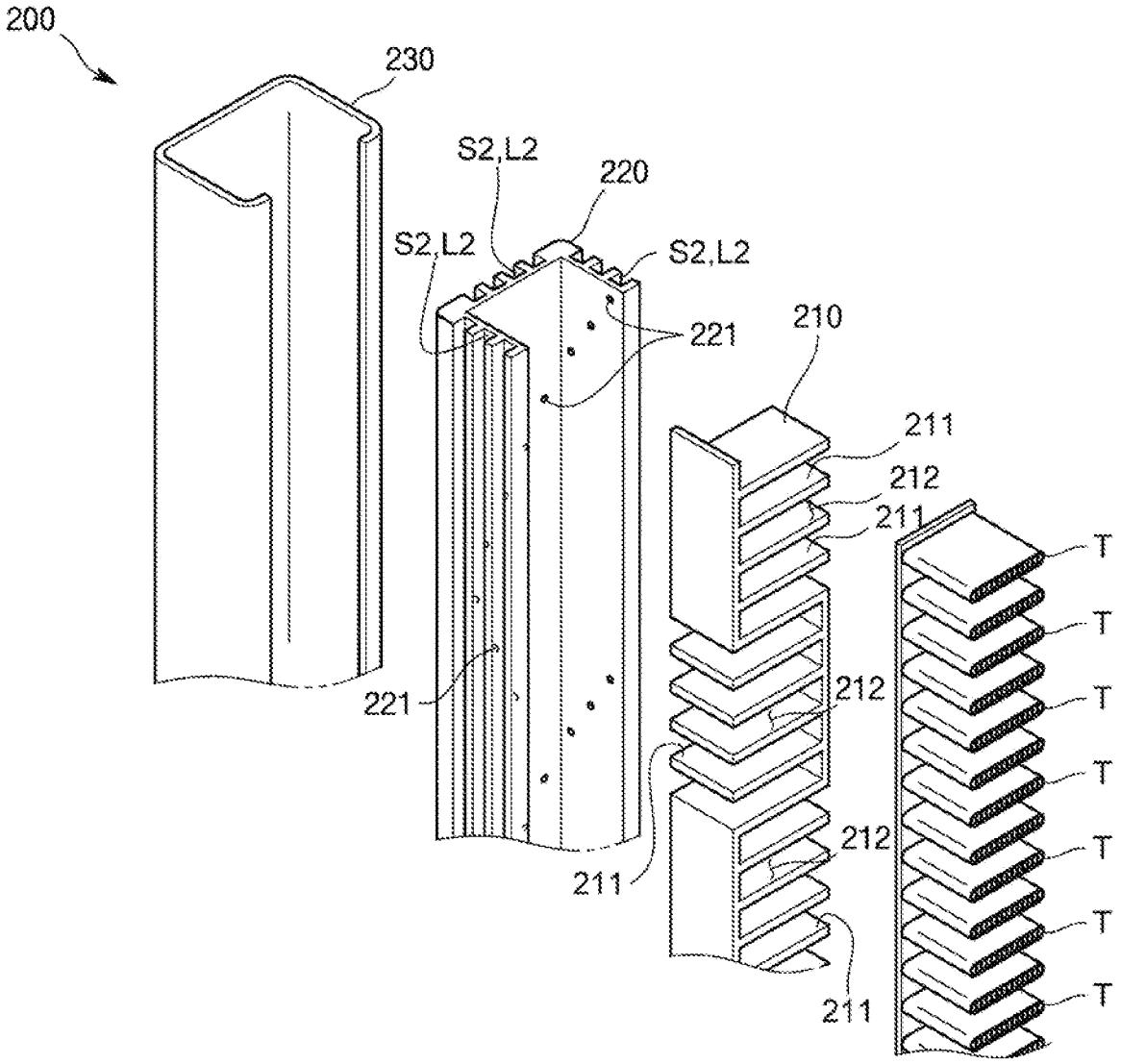
FIG. 5 is an exploded view illustrating a downstream structure of the refrigerant distributor connected to the plurality of small diameter tubes according to an embodiment of the disclosure.
Figure 6:
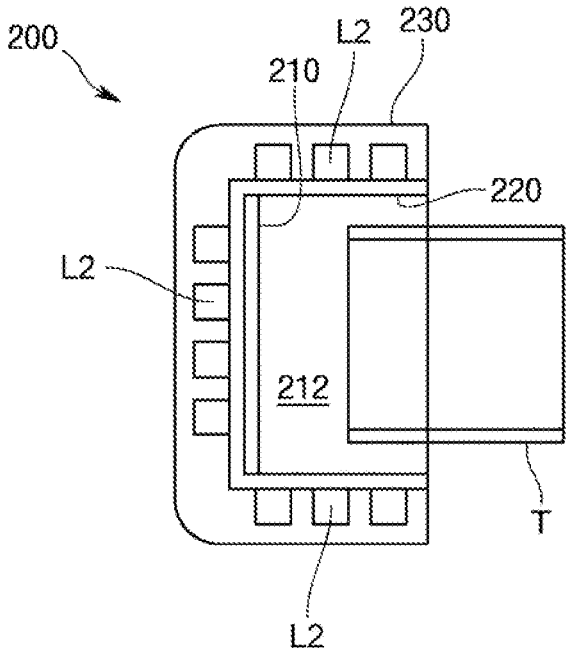
FIG. 6 is a cross-sectional view illustrating the downstream structure of the refrigerant distributor connected to the plurality of small diameter tubes according to an embodiment of the disclosure.

As illustrated in FIGS. 5 and 6, the downstream structure 200 may include a plurality of second distribution flow paths L2 provided to guide the refrigerant to the plurality of small diameter tubes T while communicating with the plurality of first distribution flow paths L1.

Figure 7:
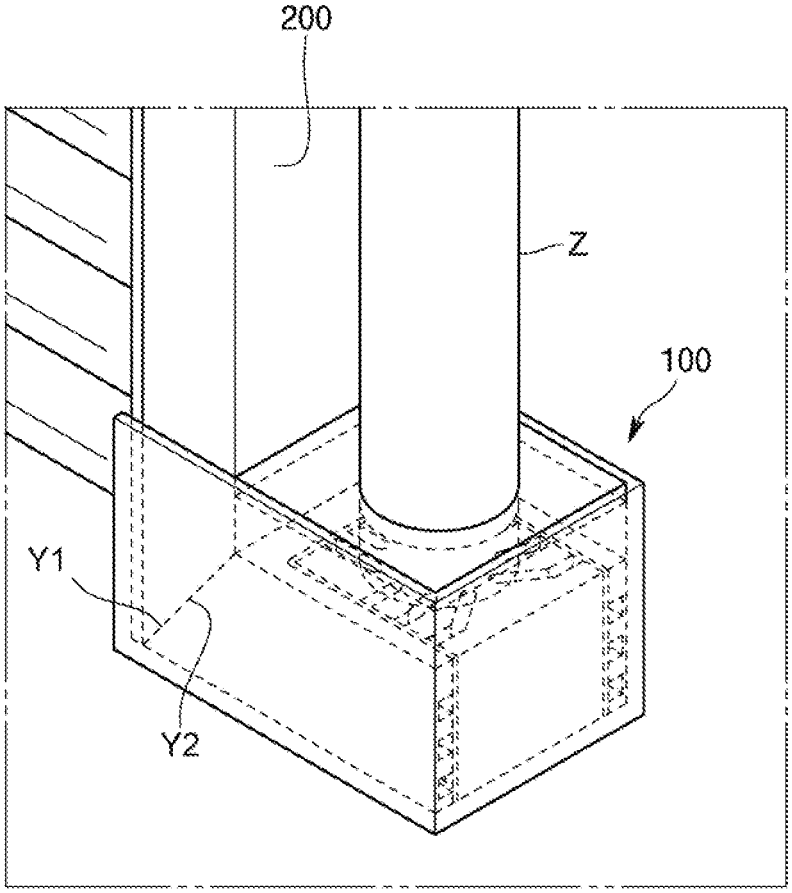
FIG. 7 is a view illustrating a portion in which the upstream structure and the downstream structure of the refrigerant distributor are connected to each other according to an embodiment of the disclosure.

As illustrated in FIG. 7, a connection portion between the upstream structure 100 and the downstream structure 200 may be provided in such a way that an outlet of the transverse flow path T2 is arranged on a first inclined surface Y1 that is vertically inclined with respect to a flow direction of the transverse flow path T2, and an inlet of the second distribution flow path L2 is arranged on a second inclined surface Y2 that is overlapped with the first inclined surface Y1. Accordingly, by overlapping the first inclined surface Y1 with the second inclined surface Y2, the plurality of lateral flow paths T2 and the plurality of second distribution flow paths L2 may communicate with each other in one-to-one correspondence.

Referring again to FIGS. 5 and 6, the downstream structure 200 according to an embodiment may include a partition member 210 including a partition space 212 corresponding to the plurality of small diameter tubes T, respectively, an opening forming member 220 on which a refrigerant outlet 221 provided to allow the partition space 212 to communicate with the second distribution flow path L2, is formed, and a flow path forming member 230 provided to form the second distribution flow path L2 between the opening forming member 220 and the flow path forming member 230.

The partition member 210 may be a portion to which the plurality of small diameter tubes T is connected, and the partition member 210 may include a plurality of partition plates 211 provided to define the partition space 212, which corresponds to each of the plurality of small diameter tubes T, as a separated space.

In an embodiment, the plurality of small diameter tubes T may be formed in a plurality of stages in the vertical direction, the plurality of partition plates 211 may be arranged along the vertical direction and at the same time, the plurality of partition spaces 212 corresponding to the plurality of small diameter tubes T may be arranged along the vertical direction. The plurality of small diameter tubes T and the plurality of partition spaces 212 may communicate with each other in one-to-one correspondence. However, one partition space 212 may communication with a plurality (e.g., two or more) of small diameter tubes T.

The partition member 210 may be fitted into the opening forming member 220 so as to cover the partition space 212, and the opening forming member 220 may include the plurality of refrigerant outlets 221 provided to allow the plurality of partition spaces 212 to communicate with the second distribution flow path L2. For example, the opening forming member 220 may be provided in such a way that a flat member is bent into a '⊏' shape, and the partition member 210 may be fitted into the opening forming member 220. In addition, one or more of the plurality of refrigerant outlets 221 provided to discharge the refrigerant, which flows on the second distribution flow path L2, to the partition space 212 may be formed on each surface (three inner surfaces according to an embodiment) that is bent in a '⊏' shape.

The refrigerant outlet 221 may be arranged along the vertical direction like the plurality of partition spaces 212, and may be spirally arranged in the flow direction of the second distribution flow path L2, that is, in the vertical direction. In addition, according to an embodiment, the plurality of partition spaces 212 and the plurality of refrigerant outlets 221 may be in communication with each other in one-to-one correspondence, but two or more of the plurality of refrigerant outlets 221 may correspond to and communicate with one partition space 212. All the refrigerant outlets 221 have the same opening diameter according to an embodiment, but the size of the opening diameter may vary according to the position of the refrigerant outlet. For example, an opening diameter of the refrigerant outlet 221 in the upper side may be greater than an opening diameter of the refrigerant outlet 221 in the lower side. As shown in FIG. 5, a shape of the refrigerant outlet 221 may be circular. However, the disclosure is not so limited and a shape of the refrigerant outlet 221 may vary. As shown in FIG. 5, a plurality of refrigerant outlets 221 may be arranged (e.g., in a diagonal pattern) on each of the sides of the opening forming member 220.

The opening forming member 220 may include a slit S2 penetrating a plurality of portions of each outer surface in the vertical direction. The slit S2 does not necessarily have to be in the vertical direction, and instead the slit S2 may be inclined with respect to the vertical direction. By covering the outer surface of the opening forming member 220 with the flow path forming member 230 described later, the slit S2 may be covered, thereby forming the second distribution flow path L2.

The opening forming member 220 may be fitted into the flow path forming member 230 and thus the flow path forming member 230 may form the second distribution flow path L2 between the opening forming member 220 and the flow path forming member 230. For example, the flow path forming member 230 may include an inner surface (three inner surfaces according to an embodiment) arranged opposite to the outer surface of the opening forming member 220, and similar to the opening forming member 220, the flow path forming member 230 may be formed in a '⊏' shape. By covering the slit S2 formed on an outer circumferential surface of the opening forming member 220 with an inner circumferential surface of the flow path forming member 230, the slit S2 may be closed so as to form the second distribution flow path L2, and the second distribution flow path L2 may communicate with the partition space 212 through the refrigerant outlet 221.

Accordingly, in the above-described configuration, the adjacent partition spaces 212 may be provided to communicate with the different second distribution flow paths L2.

For example, in an embodiment, the plurality of second distribution flow paths L2 may correspond to the plurality of refrigerant outlets 221 in one-to-one correspondence, and the plurality of refrigerant outlets 221 may correspond to the plurality of partition spaces 212 in one-to-one correspondence. Accordingly, all of the partition spaces 212 may be provided to communicate with the second distribution flow path L2 different from the second distribution flow path L2 communicating with the adjacent partition space 212.

However, it is not required for all of the partition spaces 212 to communicate with the second distribution flow path L2 different from the adjacent partition space 212. For example, two consecutive partition spaces 212 and the next two consecutive partition spaces 212 may communicate with a different second distribution flow path L2. In other words, a plurality of consecutive partition spaces 212 may communicate with a common second distribution flow path L2.

As for the refrigerant distributor 50 configured as described above, because the plurality of partition spaces 212 and the plurality of second distribution flow paths L2 communicate with each other through the refrigerant outlet 221 formed in the opening forming member 220, an amount of refrigerant may be supplied to the small diameter tube T corresponding to the partition space 212 according to the size and the number of the refrigerant outlet 221.

Therefore, by changing the size and number of the refrigerant outlets 221, it is possible to adjust the amount of refrigerant supplied to each of the plurality of small diameter tubes T without increasing the size of the refrigerant distributor 50 or increasing the number of refrigerant distributors 50. Therefore, it is possible to distribute the appropriate amount of refrigerant supplied to the multi-pass small diameter tube T.

For example, in the vertical outdoor unit, a difference in the heat exchange performance may occur due to the difference in the wind speed between the upper part close to the fan and the lower part far from the fan. However, because the plurality of partition spaces 212 and the plurality of refrigerant outlets 221 are arranged in the vertical direction, it is possible to distribute the appropriate amount of refrigerant supplied to each of the small diameter tubes, and for example, a relatively large amount of refrigerant may be supplied to the upper small diameter tube in which the wind speed is high, and a relatively small amount of refrigerant may be supplied to the lower small diameter tube in which the wind speed is low. Therefore, it is possible to improve the heat exchange performance.

In addition, because the partition spaces 212 adjacent to each other communicate with the different second distribution flow paths L2, it is possible to prevent the amount of refrigerant supplied to the partition space 212 from affecting each other, and the amount of refrigerant supplied to the small diameter tube T corresponding to the adjacent partition spaces 212 may be more easily adjusted.

Further, because the protrusion 112 is provided in the connecting member 110 of the upstream structure 100, refrigerant which collides with the protrusion 112 may be divided into the plurality of inlets formed around the protrusion 112, and thus it is possible to better equalize a flow rate distributed to the plurality of first distribution flow paths L1.

Figure 8:
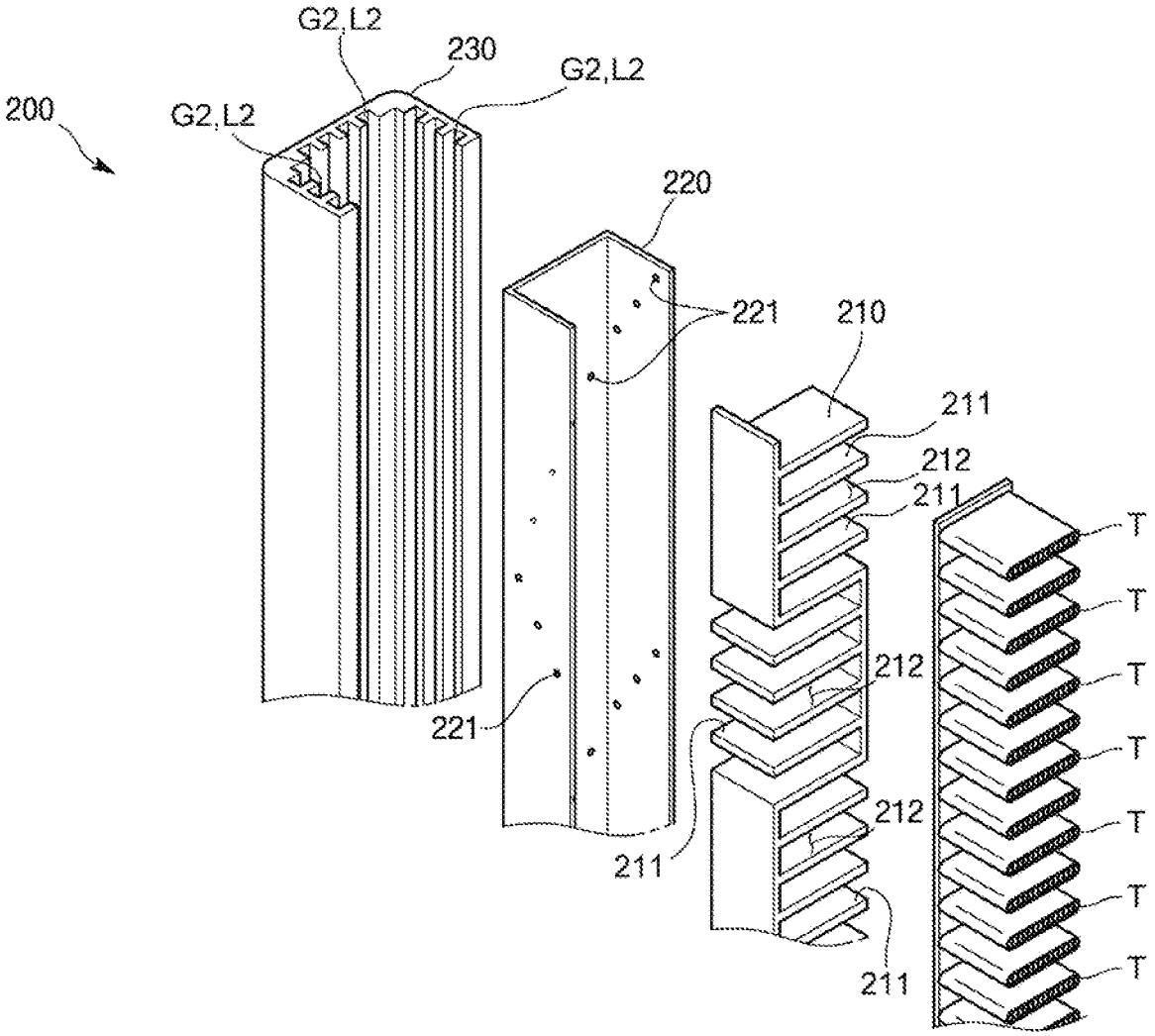
FIG. 8 is a view illustrating an embodiment of the downstream structure illustrated in FIG. 5.

The configurations of the example embodiment disclosed above are not limited thereto. For example, in the above embodiment, the slit S2 is formed on the outer surface of the opening forming member 220, and the second distribution flow path L2 is formed by closing the slit S2 with the inner surface of the flow path forming member 230. Alternatively, a groove G2 corresponding to the slit S2 of the above embodiment may be formed on the inner surface of the flow path forming member 230 and the second distribution flow path L2 may be formed by closing the groove G2 with the outer surface of the opening forming member 220, as illustrated in FIG. 8.

Figure 9:
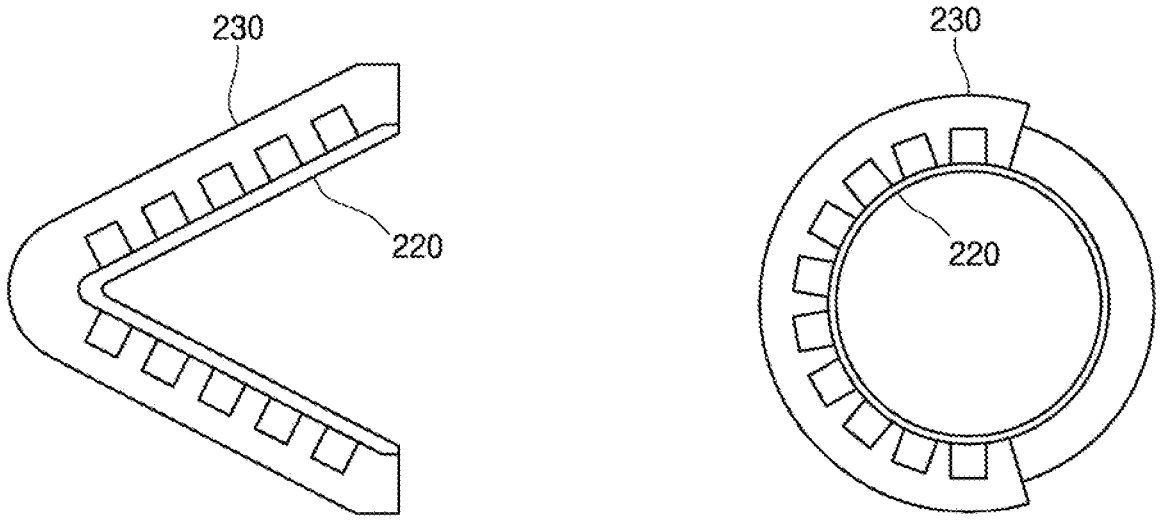
FIG. 9 is a view illustrating an embodiment of a flow path forming member illustrated in FIG. 5.

In addition, the opening forming member 220 or the flow path forming member 230 according to the above embodiment is formed in such a way that a flat member is bent in a '⊏' shape. Alternatively, the opening forming member 220 or the flow path forming member 230 may be formed in such a way that a flat member is bent in a triangular shape or is curved in an arc shape, as illustrated in FIG. 9.

Figure 10:
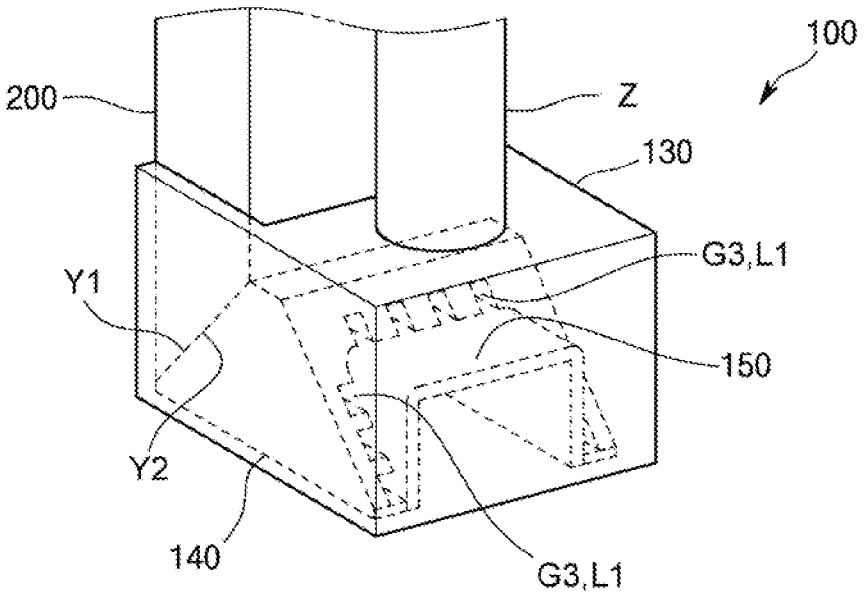
FIG. 10 is a view illustrating an embodiment of the upstream structure illustrated in FIG. 7.
Figure 11:
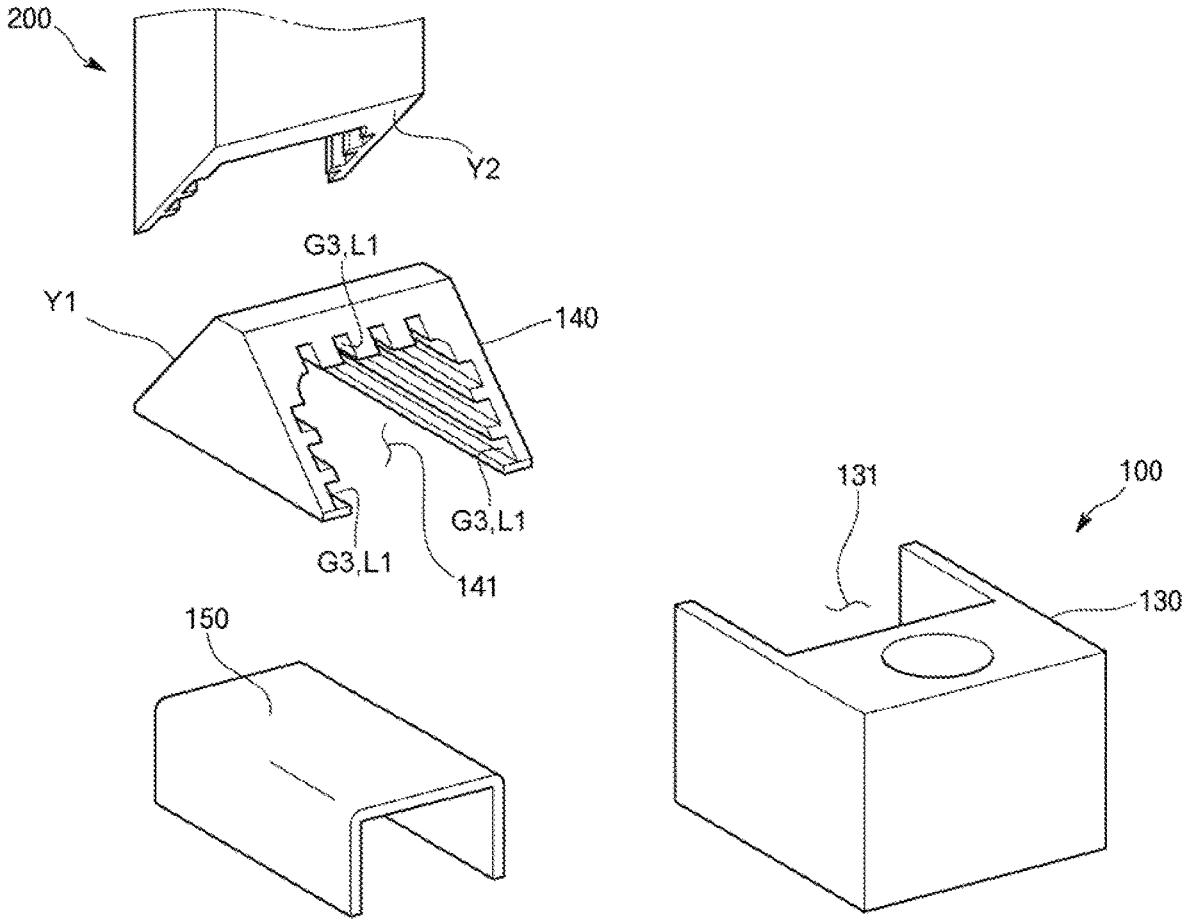
FIG. 11 is an exploded view illustrating the upstream structure illustrated in FIG. 10.

The first distribution flow path L1 is formed in the connecting member 110 in the shape of a square column according to an embodiment. Alternatively, the first distribution flow path L1 may be formed by a plurality of members, as illustrated in FIGS. 10 and 11.

For example, the upstream structure 100 may include a first member 130 to which the main pipe Z is connected and the refrigerant is introduced, a second member 140 fitted into a refrigerant inlet space 131 formed in the first member 130 and in which a through hole 141, which is provided to allow the refrigerant inlet space 131 to communicate with the downstream structure 200, is formed, and a third member 150 fitted into the through hole 141 of the second member 140. Accordingly, a plurality of grooves G3 formed on one side of the inner circumferential surface of the second member 140 or the outer circumferential surface of the third member 150 may be closed on the other side of the inner circumferential surface of the second member 140 or the outer circumferential surface of the third member 150, thereby forming the plurality of the first distribution flow paths L1.

Figure 12:
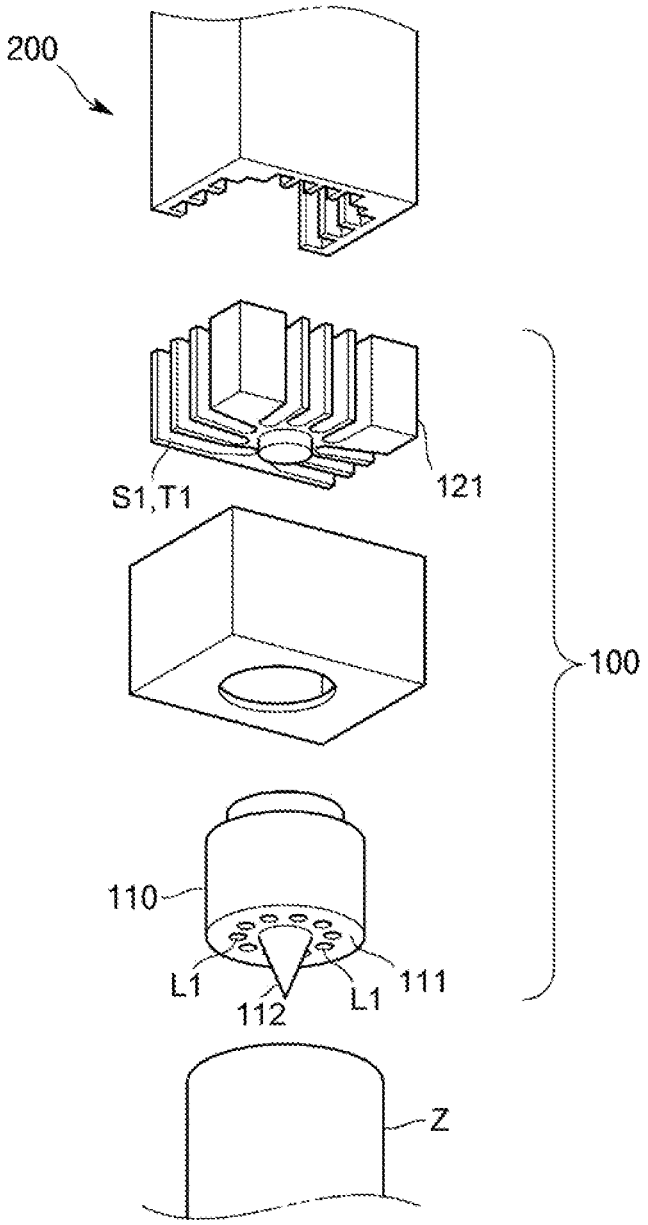
FIG. 12 is a view illustrating an embodiment of the downstream structure illustrated in FIG. 4.

In addition, as illustrated in FIG. 12, the connecting member 110 or the longitudinal flow path forming member 121 forming the upstream structure 100 according to an embodiment may be inverted in the vertical direction and then used.

In this case, because the transverse flow path forming member 122 or the communication hole member 123 according to an embodiment is not required in the upstream structure 100, it is possible to more simply configure the upstream structure 100.

Figure 13:
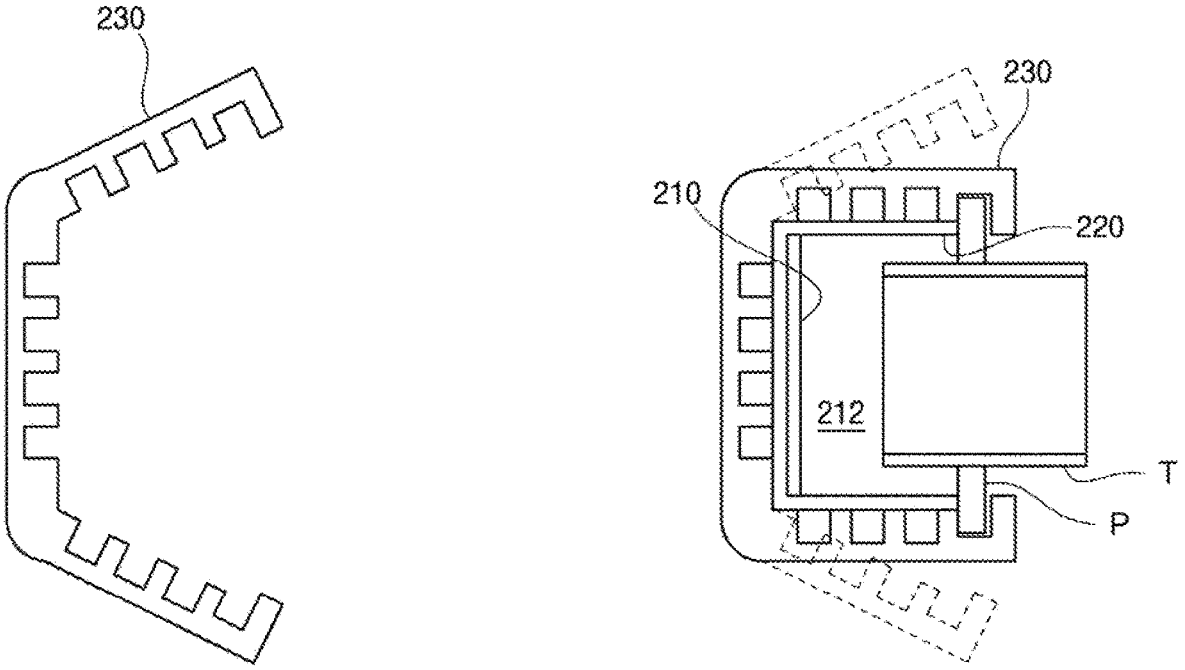
FIG. 13 is a view illustrating an embodiment of a flow path forming member illustrated in FIG. 5.

Further, as illustrated in FIG. 13, the flow path forming member 230 may allow a free end to be extended and open. In this case, a flat plate P extending radially outwardly may be provided in the small diameter tube T, which is a multi-bored flat tube, and a concave portion coupled to the flat plate P may be provided on an inner surface of the free end.

In this configuration, by coupling the concave portion of the free end to the flat plate P, the downstream structure 200 and the flat plate P may be temporarily assembled, which may help improve productivity, such as reducing welding defects.

As is apparent from the above description, it is possible to appropriately distribute the amount of refrigerant supplied to the plurality of small diameter tubes.

Although example of the disclosure have been shown and described, it would be appreciated by those skilled in the art that changes may be made to these embodiments without departing from the principles and spirit of the disclosure, the scope of which is defined in the claims and their equivalents.

What is claimed is:

1. An air conditioner, comprising:

a blower; and a heat exchanger to perform heat exchange between refrigerant and air passed from the blower, the heat exchanger including:

a main pipe through which refrigerant is to flow, a plurality of tubes connected to the main pipe to allow refrigerant passing through the plurality of tubes to exchange heat with the air, and a refrigerant distributor disposed between the main pipe and the plurality of tubes, and configured to distribute refrigerant passing through the main pipe to the plurality of tubes, wherein the refrigerant distributor includes:

an upstream structure connected to the main pipe and including a plurality of first distribution flow paths to which the refrigerant passing through the main pipe is distributed, and a downstream structure including a plurality of second distribution flow paths communicating with the plurality of first distribution flow paths, and a plurality of refrigerant outlets communicating with the plurality of second distribution flow paths so as to allow the refrigerant to be discharged to the plurality of tubes, wherein the downstream structure includes:

a partition member connected to the plurality of tubes, an opening forming member in which the plurality of refrigerant outlets are formed, and a flow path forming member to allow the opening forming member to be fitted into the flow path forming member so as to form the plurality of second distribution flow paths between the opening forming member and the flow path forming member.

2. The air conditioner of claim 1, wherein the partition member includes:

a plurality of partition spaces corresponding to the plurality of tubes, and a plurality of partition plates to define the plurality of partition spaces.

3. The air conditioner of claim 2, wherein the plurality of refrigerant outlets are configured to allow the plurality of second distribution flow paths to communicate with the plurality of partition spaces, and the opening forming member includes a plurality of slits fitted to the flow path forming member to form the plurality of second distribution flow paths.

4. The air conditioner of claim 3, wherein the plurality of refrigerant outlets have different sizes to adjust an amount of refrigerant discharged into the plurality of tubes.

5. The air conditioner of claim 3, wherein a number of the refrigerant outlets which communicate with each of the plurality of tubes is varied to adjust an amount of refrigerant discharged into the plurality of tubes.

6. The air conditioner of claim 3, wherein the plurality of tubes include a plurality of stages in a vertical direction, and the plurality of partition spaces corresponding to the plurality of tubes and the plurality of refrigerant outlets communicating with the plurality of partition spaces, are disposed along the vertical direction.

7. The air conditioner of claim 6, wherein the plurality of refrigerant outlets are spirally disposed along a flow direction of the plurality of second distribution flow paths.

8. The air conditioner of claim 1, wherein the upstream structure includes:

a connecting member to which the main pipe is connected and the plurality of first distribution flow paths are formed, and a flow path changing body connected to the connecting member so as to change a direction of the refrigerant flowing in the plurality of first distribution flow paths to allow the refrigerant to flow to the plurality of second distribution flow paths.

9. The air conditioner of claim 8, wherein the connecting member includes:

a collision surface with which the refrigerant passing through the main pipe collides, and a protrusion protruding in a direction, which is opposite to a direction in which the refrigerant flows, and disposed in a central portion of the collision surface, wherein the plurality of first distribution flow paths are formed around the protrusion to pass through the connecting member so as to allow an inlet of the plurality of first distribution flow paths to be formed on the collision surface.

10. The air conditioner of claim 8, wherein the flow path changing body includes:

a longitudinal flow path forming member, in which a longitudinal flow path communicating with the plurality of first distribution flow paths is formed to allow the refrigerant to flow in a same direction as a direction in which the refrigerant flows through the plurality of first distribution flow paths, a transverse flow path forming member in which a transverse flow path intersecting with the longitudinal flow path is formed, and a communication hole member in which a communication hole is formed to allow the longitudinal flow path to communicate with the transverse flow path.

11. A heat exchanger, comprising:

a main pipe through which refrigerant is to flow;

a plurality of tubes connected to the main pipe to allow refrigerant passing through the plurality of tubes to exchange heat with air; and a refrigerant distributor disposed between the main pipe and the plurality of tubes, and configured to distribute refrigerant passing through the main pipe to the plurality of tubes, wherein the refrigerant distributor includes:

an upstream structure connected to the main pipe and including a connecting member in which a plurality of first distribution flow paths, to which the refrigerant passing through the main pipe is distributed, are formed, and a downstream structure including a flow path forming member in which a plurality of second distribution flow paths communicating with the plurality of first distribution flow paths are formed, and an opening forming member in which a plurality of refrigerant outlets which communicate with the plurality of second distribution flow paths so as to allow the refrigerant to be discharged to the plurality of tubes, are formed, wherein the downstream structure further includes a partition member which includes:

a plurality of partition spaces connected to the plurality of tubes, and a plurality of partition plates to define the plurality of partition spaces, wherein the opening forming member includes a plurality of slits fitted to the flow path forming member to form the plurality of second distribution flow paths.

12. The heat exchanger of claim 11, wherein the plurality of refrigerant outlets have different sizes to adjust an amount of refrigerant discharged into the plurality of tubes.

13. The heat exchanger of claim 11, wherein a number of refrigerant outlets which communicate with each of the plurality of tubes is varied to adjust an amount of refrigerant discharged into the plurality of tubes.

14. The heat exchanger of claim 11, wherein the plurality of tubes include a plurality of stages in a vertical direction, and the plurality of partition spaces corresponding to the plurality of tubes and the plurality of refrigerant outlets communicating with the plurality of partition spaces, are disposed along the vertical direction.

15. The heat exchanger of claim 14, wherein the plurality of refrigerant outlets are spirally disposed along a flow direction of the plurality of second distribution flow paths.

16. The heat exchanger of claim 11, wherein the upstream structure includes a flow path changing body connected to the connecting member so as to change a direction of the refrigerant flowing in the plurality of first distribution flow paths to allow the refrigerant to flow to the plurality of second distribution flow paths, wherein the flow path changing body includes:

a longitudinal flow path forming member, in which a longitudinal flow path communicating with the plurality of first distribution flow paths is formed to allow the refrigerant to flow in a same direction as a direction in which the refrigerant flows through the plurality of first distribution flow paths, a transverse flow path forming member in which a transverse flow path intersecting with the longitudinal flow path is formed, and a communication hole member in which a communication hole is formed to allow the longitudinal flow path to communicate with the transverse flow path.

17. The heat exchanger of claim 11, wherein the connecting member includes:

a collision surface with which the refrigerant passing through the main pipe collides, and a protrusion protruding in a direction, which is opposite to a direction in which the refrigerant flows, and disposed in a central portion of the collision surface, wherein the plurality of first distribution flow paths are formed around the protrusion to pass through the connecting member, and an inlet of the plurality of first distribution flow paths is formed on the collision surface.

18. A refrigerant distributor to be disposed between a main pipe and a plurality of tubes of a heat exchanger and configured to distribute refrigerant passing through the main pipe to the plurality of tubes, the refrigerant distributor comprising:

an upstream structure connected to the main pipe and including a connecting member in which a plurality of first distribution flow paths, to which the refrigerant passing through the main pipe is distributed, are formed, and a downstream structure including a plurality of second distribution flow paths communicating with the plurality of first distribution flow paths so as to distribute refrigerant to the plurality of tubes, wherein the downstream structure includes:

a flow path forming member in which the plurality of second distribution flow paths communicating with the plurality of first distribution flow paths are formed, a partition member in which a plurality of partition spaces connected to the plurality of tubes are formed, and an opening forming member in which a plurality of refrigerant outlets, which allows the plurality of second distribution flow paths to communicate with the plurality of partition spaces, are formed.

* * * * *